US011720042B2

(12) United States Patent
Kuo et al.

(10) Patent No.: US 11,720,042 B2
(45) Date of Patent: Aug. 8, 2023

(54) PRINTING SYSTEM FOR PRINTING ON TABBED MEDIA

(71) Applicant: Eastman Kodak Company, Rochester, NY (US)

(72) Inventors: Chung-Hui Kuo, Fairport, NY (US); Thomas L. Schwartz, Fairport, NY (US); David M. Gotham, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 17/516,827

(22) Filed: Nov. 2, 2021

(65) Prior Publication Data

US 2022/0155717 A1 May 19, 2022

Related U.S. Application Data

(60) Provisional application No. 63/113,269, filed on Nov. 13, 2020.

(51) Int. Cl.
*G03G 15/00* (2006.01)

(52) U.S. Cl.
CPC ..... *G03G 15/5008* (2013.01); *G03G 15/5029* (2013.01); *G03G 15/5054* (2013.01); *G03G 15/5062* (2013.01); *G03G 15/6591* (2013.01); *G03G 15/607* (2013.01); *G03G 2215/00523* (2013.01); *G03G 2215/00725* (2013.01)

(58) Field of Classification Search
CPC ..... G03G 15/5062; G03G 15/5029; G03G 2215/00523; G03G 15/5095; G03G 15/6508; G03G 15/655; G03G 15/6558; G03G 15/6594
See application file for complete search history.

(56) References Cited

U.S. PATENT DOCUMENTS 7,983,584 B2 * 7/2011 Okamoto ..... G03G 15/5029 399/82
8,448,932 B2 * 5/2013 Kubota ..... G03G 15/5029 700/223

(Continued)

FOREIGN PATENT DOCUMENTS

JP 2016115221 A * 6/2016

OTHER PUBLICATIONS

Translation to English of JP-2016115221.*

(Continued)

*Primary Examiner* — Arlene Heredia
(74) *Attorney, Agent, or Firm* — David A. Novais

(57) ABSTRACT

A printing system for printing on tabbed media having a plurality of tab positions. A media transport system picks the next sheet of tabbed media from a media tray. A detection system detects the tab position for the sheet of tabbed media. The detected tab position is compared to an expected tab position and if the detected tab position is different from the expected tab position then either the front end is used to supply image data to be printed on the sheet of tabbed media having the detected tab position, or the media transport system is controlled to direct the sheet of tabbed media into a waste receptacle and pick one or more additional sheets of tabbed media until the detected tab position is the same as the expected tab position.

7 Claims, 15 Drawing Sheets

(56) References Cited

U.S. PATENT DOCUMENTS 10,209,929 B2 * 2/2019 Takahashi ..... G06F 3/1285
10,642,210 B2 * 5/2020 Shinohara ..... G03G 15/607

OTHER PUBLICATIONS

NexPress Specialty Substrate Leveler User's Guide, Eastman Kodak Co., Publication ID: UG8350-1_en, 2008.
KODAK Digital Press: Printing on Pre-Collated Media (PCM) User Guide, Publication ID: UGSU00-00, 2019.

* cited by examiner

PRINTING SYSTEM FOR PRINTING ON TABBED MEDIA

CROSS-REFERENCE TO RELATED APPLICATIONS

This application claims the benefit of U.S. Provisional Patent Application No. 63/113,269, filed Nov. 13, 2020, which is incorporated herein by reference in its entirety.

Reference is made to commonly assigned, U.S. Patent Application Ser. No. 63/113,264, entitled: "Printing system for media with non-uniform thickness", by T. Schwartz et al.; and to commonly assigned, U.S. Patent Application Ser. No. 63/113,266 entitled: "Printing system for media with asymmetric characteristics", by C. H. Kuo et al.; each of which is incorporated herein by reference.

FIELD OF THE INVENTION

This invention pertains to the field of digital printing, and more particularly to printing on tabbed media.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multi-color print image on the receiver.

Printers can be used to print on media having non-uniform thickness profiles. However, such media can provide significant challenges. One problem that can occur is that when the media sheets are loaded into the media supply tray the media stack will be much thicker at one end than it will be at the other end. This can make it very difficult for the media supply system to reliably pick the media sheets from the media supply tray since the top surface of the media stack will not be flat and horizontal. One prior art approach to circumventing this problem is to use a mechanical leveler device which is adaptively adjusted during the printing process to maintain the top surface of the media substantially level (i.e., horizontal). One such leveler device is the Specialty Substrate Leveler for use with the NexPress/NexFinity Digital Printing Presses available from Eastman Kodak Company. The leveler device is adapted to be inserted into a conventional media tray. One disadvantage associated with the use of the leveler is that it limits the number of media sheets that can be loaded into the media tray due to the amount of space that the leveler takes up. This makes it necessary to reload media sheets in the media tray more frequently than desirable, increasing the number of required operator interventions. Additionally, the leveler is a relatively complex system and can have a significant associated cost.

There remains a need for an improved method to print on media having non-uniform thickness characteristics or other asymmetric media characteristics.

SUMMARY OF THE INVENTION

The present invention relates to a printing system for printing on tabbed media having a plurality of tab positions, including:

- a printing module for printing on the sheets of tabbed media;
- a front end for supplying image data to the printing module;
- a media supply including a media tray adapted to be loaded with a plurality of sheets of tabbed media;
- a media transport system configured to pick a next sheet of tabbed media from the media tray and direct it to the printing module;
- a detection system configured to detect the tab position of the sheet of tabbed media; and
- a control system programmed to:
  - control the media transport system to pick the next sheet of tabbed media from the media tray;
  - control the detection system to detect the tab position for the sheet of tabbed media;
  - compare the detected tab position to an expected tab position and if the detected tab position is the same as the expected tab position instruct the front end to supply image data to be printed on the sheet of tabbed media having the expected tab position, and if the detected tab position is different from the expected tab position either:
    - instruct the front end to supply image data to be printed on the sheet of tabbed media having the detected tab position; or
    - control the media transport system to direct the sheet of tabbed media into a waste receptacle and pick one or more additional sheets of tabbed media until the detected tab position is the same as the expected tab position, and instruct the front end to supply image data to be printed on the sheet of tabbed media having the expected tab position; and
  - control the printing module to print the supplied image data on the sheet of tabbed media.

This invention has the advantage that image data can be correctly positioned on tabbed media.

It has the additional advantage that when tabbed media is loaded with an incorrect tab order or if there are other media handling errors the printer can detect and correct for the error.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
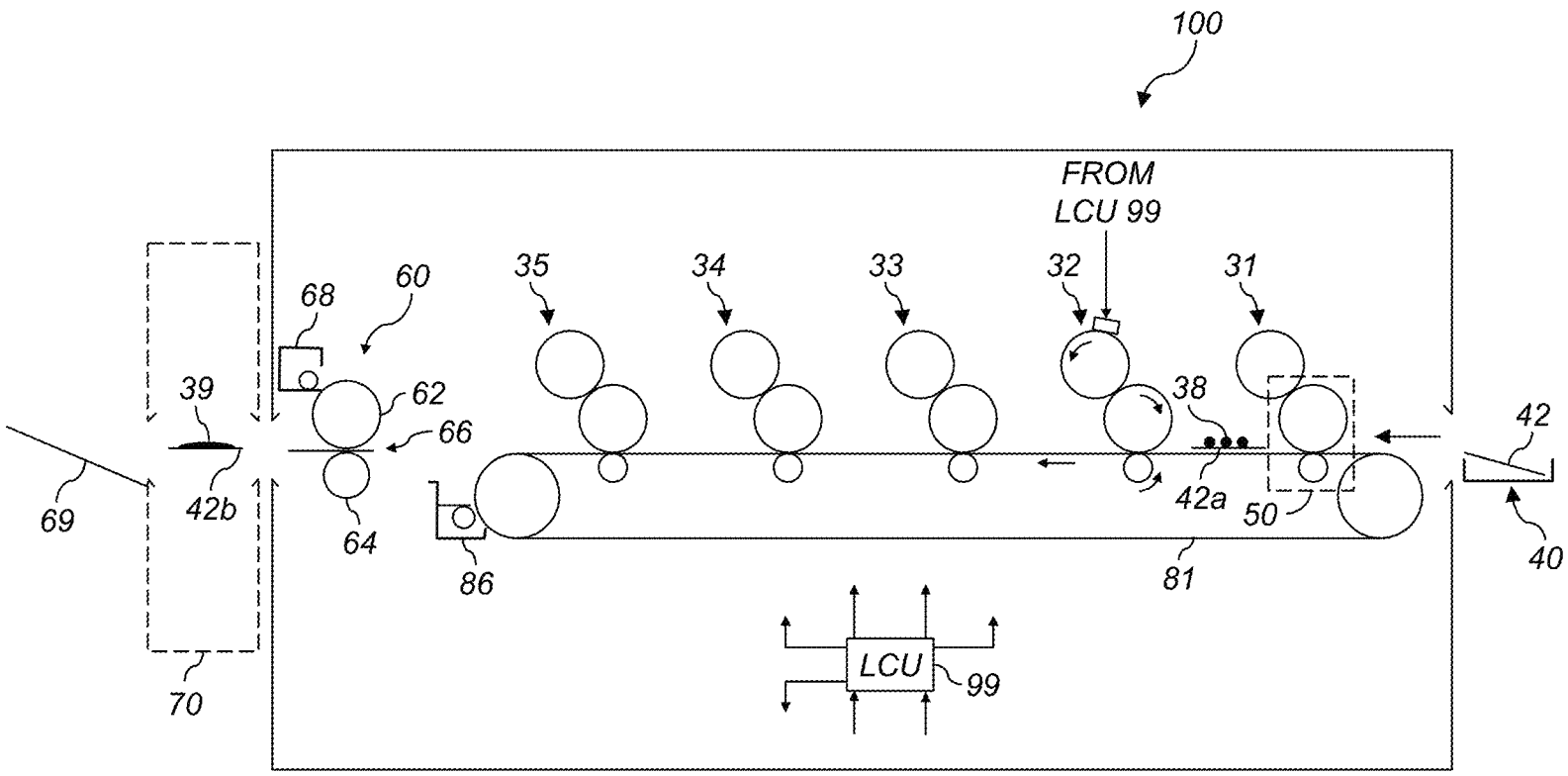
FIG. 1 (Prior Art)
FIG. 1 is an elevational cross-section of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., those having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "printing module" or a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the printing module to print. In some embodiments, the DFE permits a human operator to set up parameters such as layout, font, color, paper type, or post-finishing options. The printing module takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the printing module (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS SX 3900 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
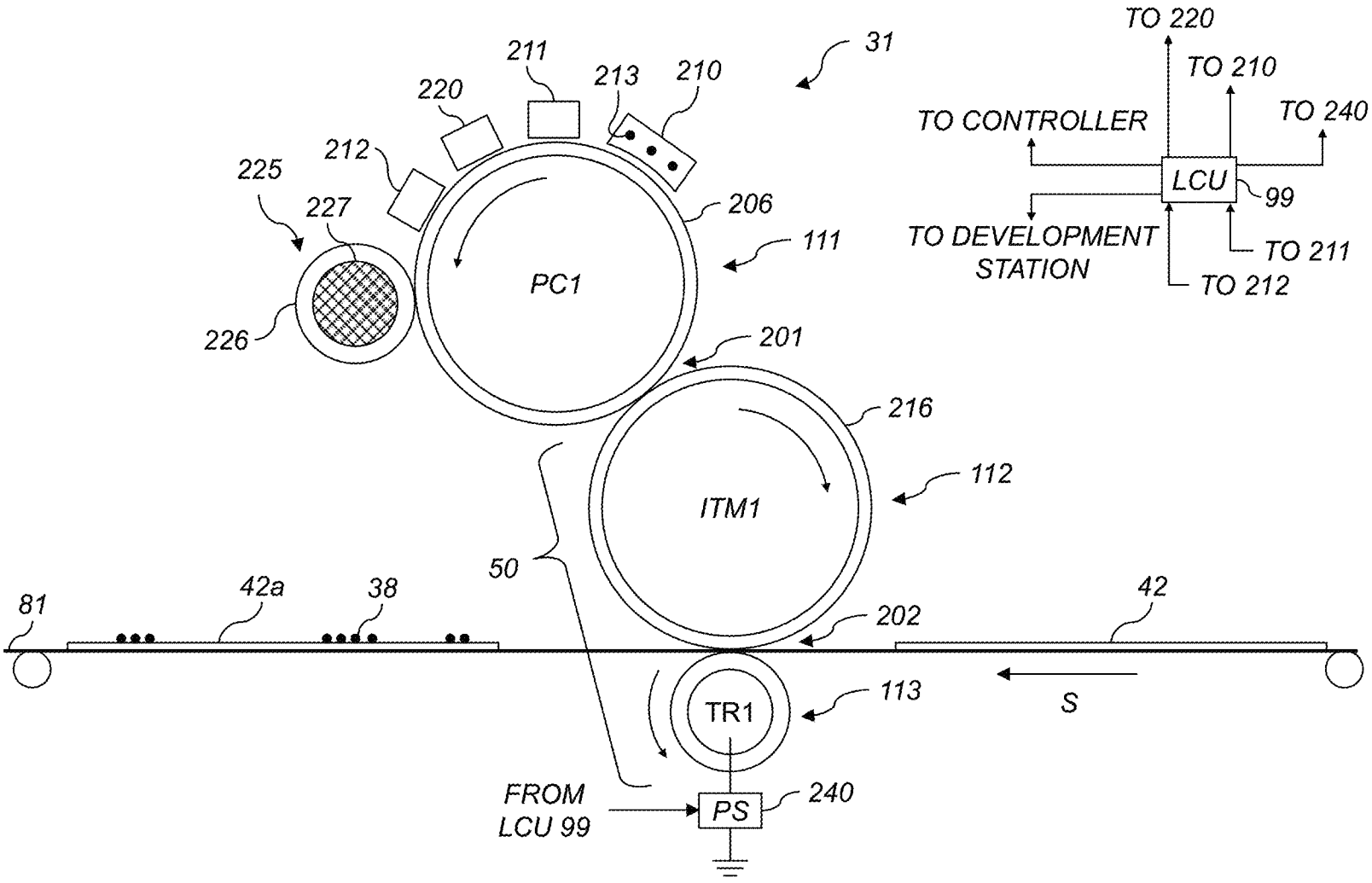
FIG. 2 (Prior Art)
FIG. 2 is an elevational cross-section of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatuses can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

In the illustrated embodiment, the fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Charging subsystem 210 applies a uniform electrostatic charge to photoreceptor 206 of imaging member 111. In an exemplary embodiment, charging subsystem 210 includes a wire grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is affected by an electrical field provided to transfer backup member 113 by power source 240, which is controlled by LCU 99. Receiver 42 can be any object or surface onto which toner can be transferred from imaging member 111 by application of the electric field. In this example, receiver 42 is shown prior to entry into a second transfer nip 202, and receiver 42*a* is shown subsequent to transfer of the print image 38 onto receiver 42*a*.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NEXPRESS SX 3900. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 25 to the receiver 42 without using a transfer member. Either transfer process is suitable when practicing this invention. An alternative method of transferring toner images involves transferring the separate toner images, in register, to a transfer member and then transferring the registered image to a receiver.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

Figure 3B:
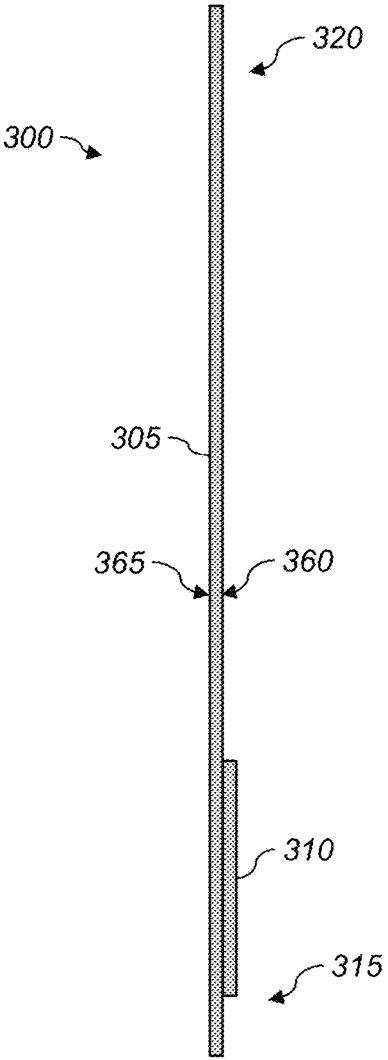
FIG. 3A-3C illustrate ID card media sheets having non-uniform thickness characteristics.
Figure 3A:
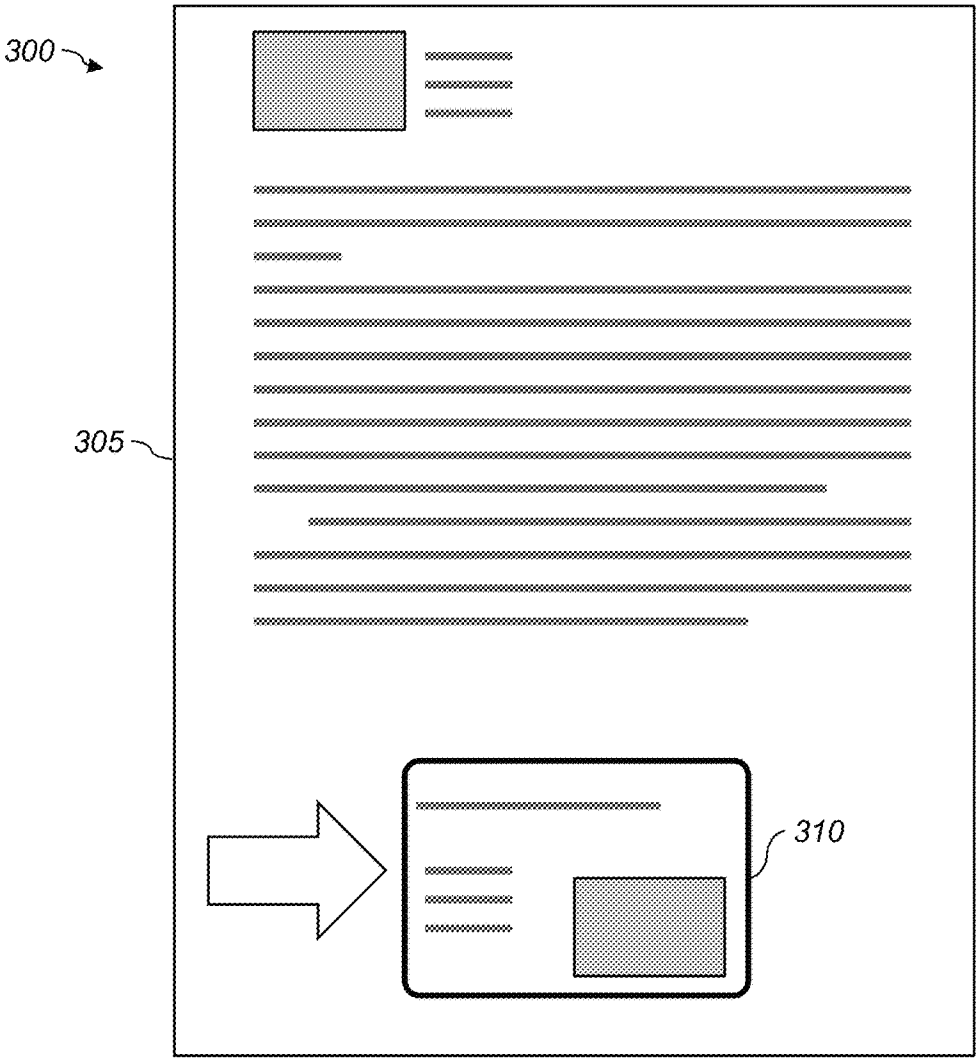
Figure 3C:
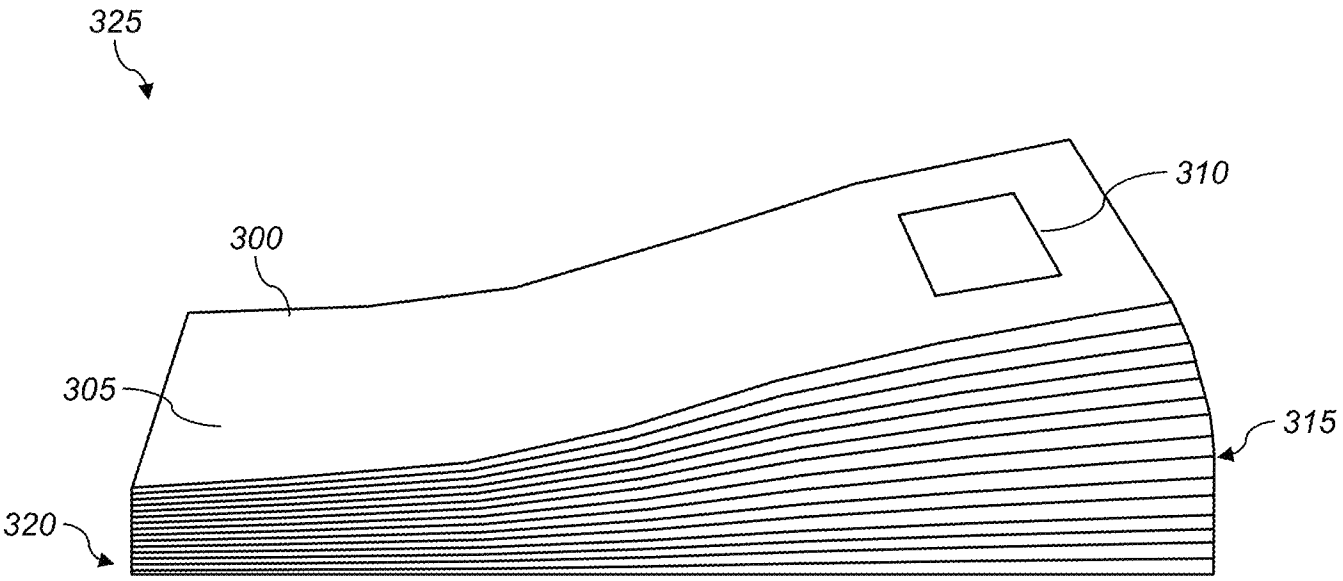

Printers 100 are capable of printing on a wide variety of different media types. Media having non-uniform thickness profiles can provide significant challenges for printing systems. One such type of media is specialty media where each media sheet 300 includes an ID card 310 affixed to a sheet of substrate 305 as illustrated in FIG. 3A. Typically the ID card 310 will be affixed to a sheet of substrate 305 with a temporary adhesive so that the ID card 310 can be removed from the substrate 305. The printer can print image content on both the substrate 305 and the ID card 310. For example, the printed ID card 310 can be a membership card for an organization, a business card for a salesman, or any other type of card appropriate for various applications. The content printed on the substrate 305 can include a cover letter with information such as instructions on how to activate the ID card 310. FIG. 3B shows a side view of the media sheet 300 of FIG. 3A. It can be seen that the thickness of the media sheet 300 is substantially thicker in the region of the ID card 310 due to the extra thickness of the ID card 310. This presents a problem when the media sheets 300 are loaded into the media supply tray (not shown) as illustrated in FIG. 3C due to the fact that the media stack 325 will be much thicker at a first end 315 having the ID card 310 than it will be at a second end 320. This can make it very difficult for the media supply system to pick the media sheets 300 from the media supply tray since the top surface of the media stack 325 will not be flat and horizontal.

Figure 4:
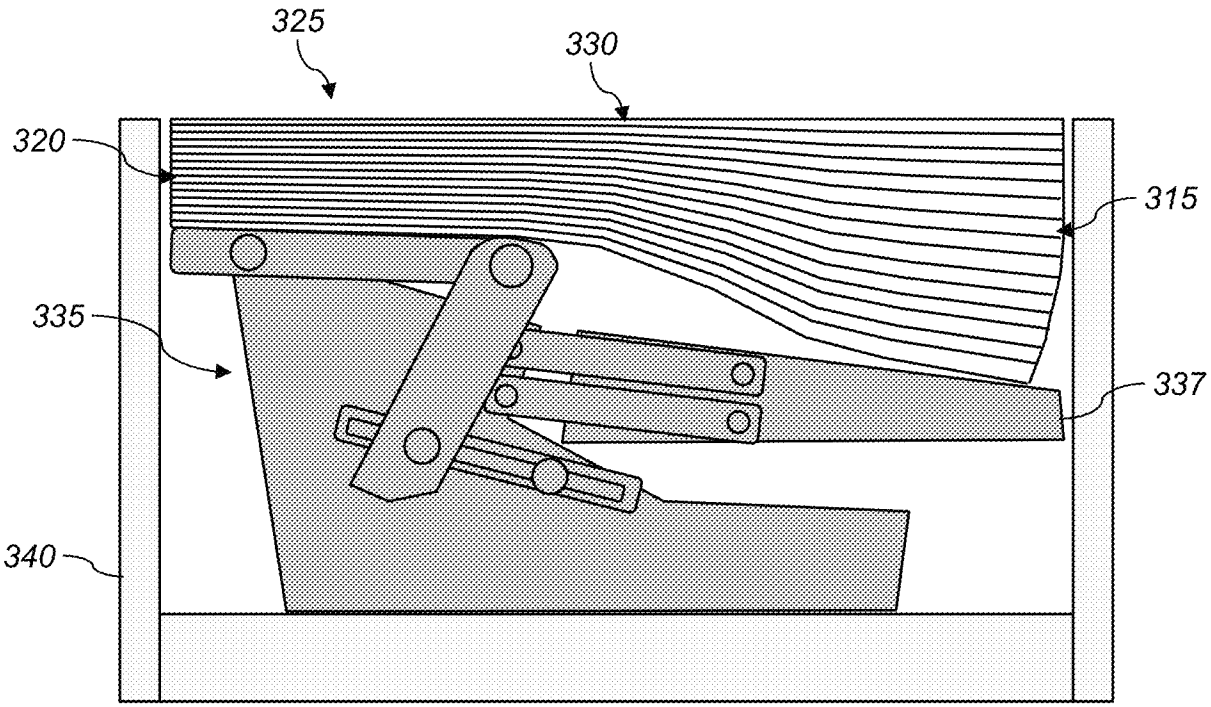
FIG. 4 (Prior Art)
FIG. 4 shows a leveler device that can be used for media having non-uniform thickness characteristics.

One prior art approach to circumventing the problems associated with the ID card media is shown in FIG. 4. In this case, a leveler 335 is inserted into the media tray 340 which enables one or both ends of the media stack 325 to be raised or lowered so that the top surface 330 of the media stack 325 can be maintained in an approximately horizontal state during printing. In the illustrated embodiment, the leveler 335 includes an adjustable platform 337 which adaptively raises and lowers the first end of the media stack 325. The position of the adjustable platform 337 is adjusted during the printing process to keep the top surface 330 substantially level (i.e., horizontal). Within the context of the present disclosure, the term "substantially level" or "substantially horizontal" means that the top surface is level to within 5 mm relative to a horizontal plane. The position can be adjusted according to a sensor which senses the height of the media stack 325 at the first and second ends 315, 320, or alternately can be adjusted based on a knowledge of the number of sheets of media that remain in the media tray 340.

Preferably, the leveler 335 is adapted to be inserted into a conventional media tray 340. One disadvantage associated with the use of the leveler 335 is that it limits the number of media sheets 300 that can be loaded into the media tray 340 due to the amount of space that the leveler 335 takes up. This makes it necessary to reload media sheets 300 in the media tray 340 more frequently than desirable, increasing the number of required operator interventions. Additionally, the leveler 335 is a relatively complex system and can have a significant associated cost.

The present invention overcomes the disadvantages of the prior art leveler 335 configuration of FIG. 4 by loading the media tray 340 with a media stack 345 in a manner where the media sheets 300 have a specified pattern of media orientations, where the specified pattern of media orientations includes at least two different media orientations. Within the context of the present disclosure, the term media orientation refers to which end of the media sheets 300 (i.e., the first end 315 or the second end 320) are oriented toward which end of the media tray 340, and also to which side of the media sheets 300 face upwards (i.e., the "front" side or the "back" side) in the media tray 340.

Figure 5:
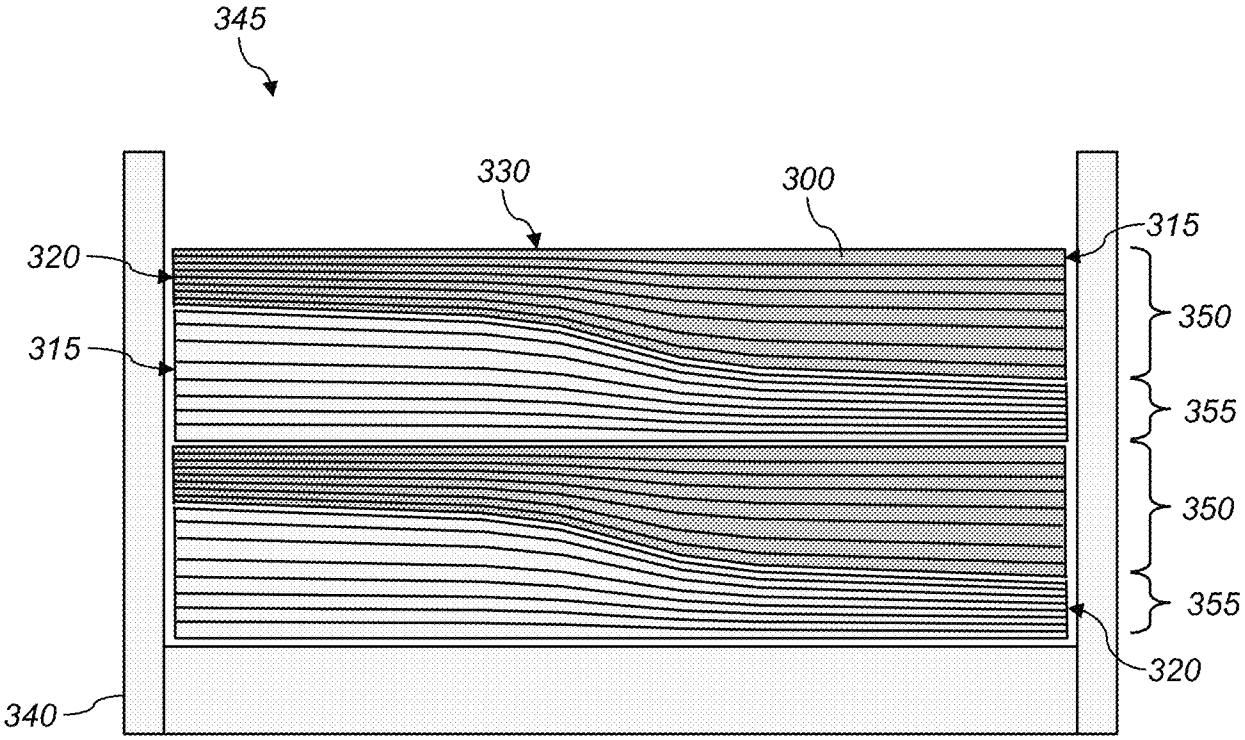
FIG. 5 illustrates a media tray loaded with a media stack having a pattern of media orientations in accordance with an exemplary embodiment.

FIG. 5 illustrates a media tray 340 loaded with a media stack 345 having an exemplary pattern of orientations according to an embodiment of the present invention. In this example, the pattern of orientations is a repeating, pattern. Each cycle of the repeating pattern includes a first set of N media sheets 300 in first media orientation 350 where the thicker first end 315 is to the right followed by a second set of N media sheets 300 in second media orientation 355 where the thicker first end 315 is to the left, where N is a predefined integer. The first end 315 of the media sheets 300 in the first orientation 350 are overlaid with the second end 320 of the media sheets in the second orientation 355.

During the printing process one end or the other of the media stack 345 may be somewhat lower than the other end depending on how many media sheets 300 have been printed, but overall the top surface 330 will be substantially more level than if all of the media sheets 300 were loaded in the same orientation. In order to keep the top surface 300 of the media stack 345 as level as possible during the printing process, it is desirable to keep N as small as possible. Preferably $N \leq 50$, and more preferably $N \leq 25$.

In order to make the process of loading the media stack 345 into the media tray 340 as easy as possible for the operator, it is desirable for the media manufacturer to supply the media sheets 300 in a convenient format. In some configurations, the media supplier supplies the media sheets 300 in individual packages (i.e., "reams") containing N sheets. The operator can then load one package of media sheets 300 with the thicker first end 315 oriented to a first end (e.g., the right end) of the media tray, followed by a second package of media sheets 300 where the thicker first end 315 is rotated 180 degrees so that it is oriented toward a second end (e.g., the left end) of the media tray 340. The operator can repeat this pattern until the media tray 340 is filled to the desired capacity. In another configuration, the media supplier supplies the media sheets 300 in packages where they are already arranged in the alternating pattern of orientations. However, this requires extra complexity for the media manufacturer.

To enable the use of media stacks 345 with alternating patterns of media orientations it is necessary that the operator be able to load the media sheets 300 into the media tray 340 with the prescribed pattern of media orientations, and that the printer know what the pattern of media orientations is in order to print the image data on each media sheet 300 in the proper orientation.

Figure 6:
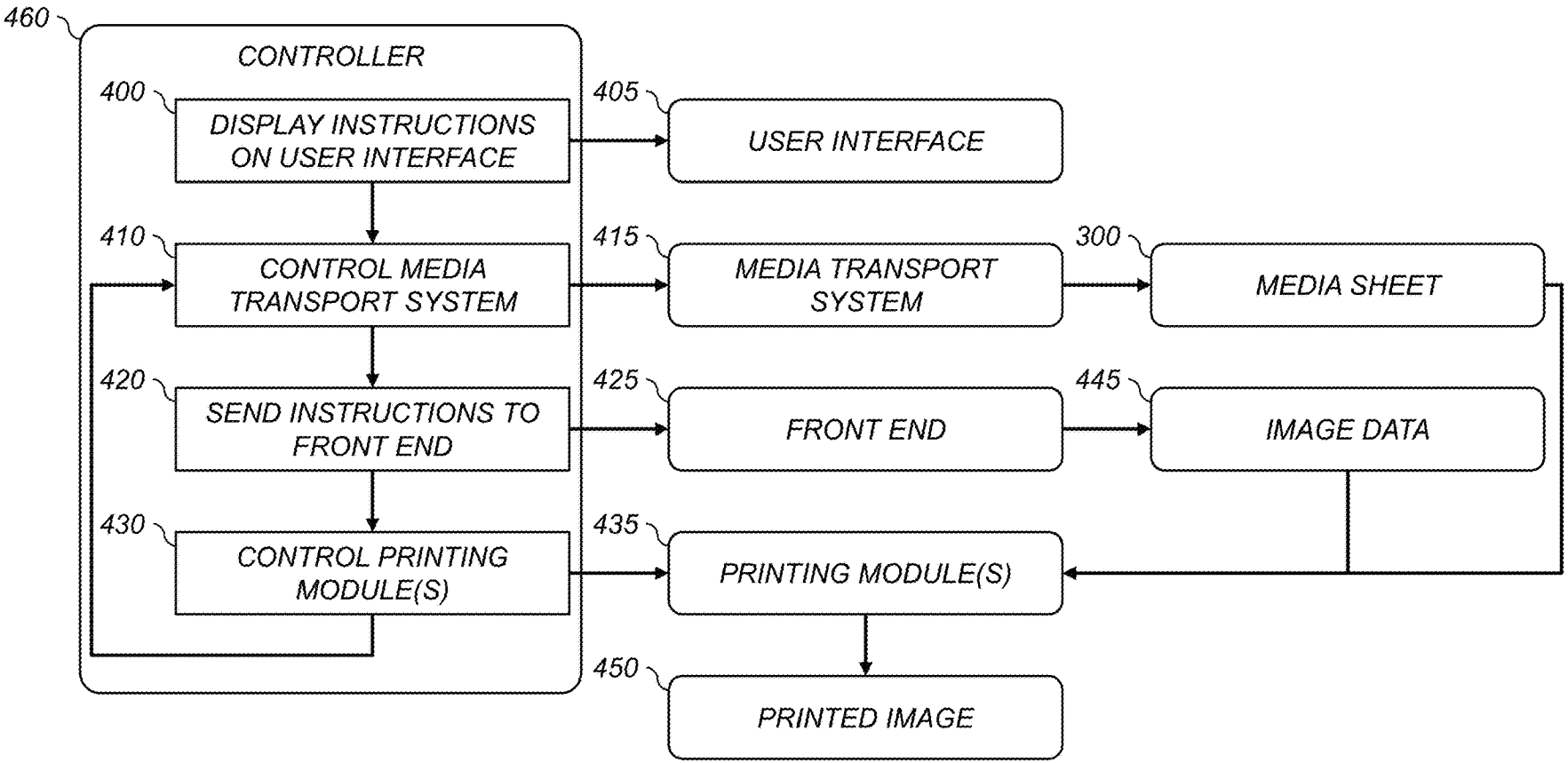
FIG. 6 shows a flowchart of a method for printing on media with non-uniform thickness characteristics in accordance with an exemplary embodiment.

FIG. 6 shows a flowchart of a method that can be used to implement the present invention in accordance with an exemplary embodiment. In the illustrated configuration, a controller 460 (such as logic and control unit 99 in FIG. 1) is used to implement a series of operations. In some embodiments the controller 460 is a single processing unit operated by appropriate software. In other embodiments, the controller 460 can include a plurality of different processing units each of which control a portion of the printer operations.

Figure 7:
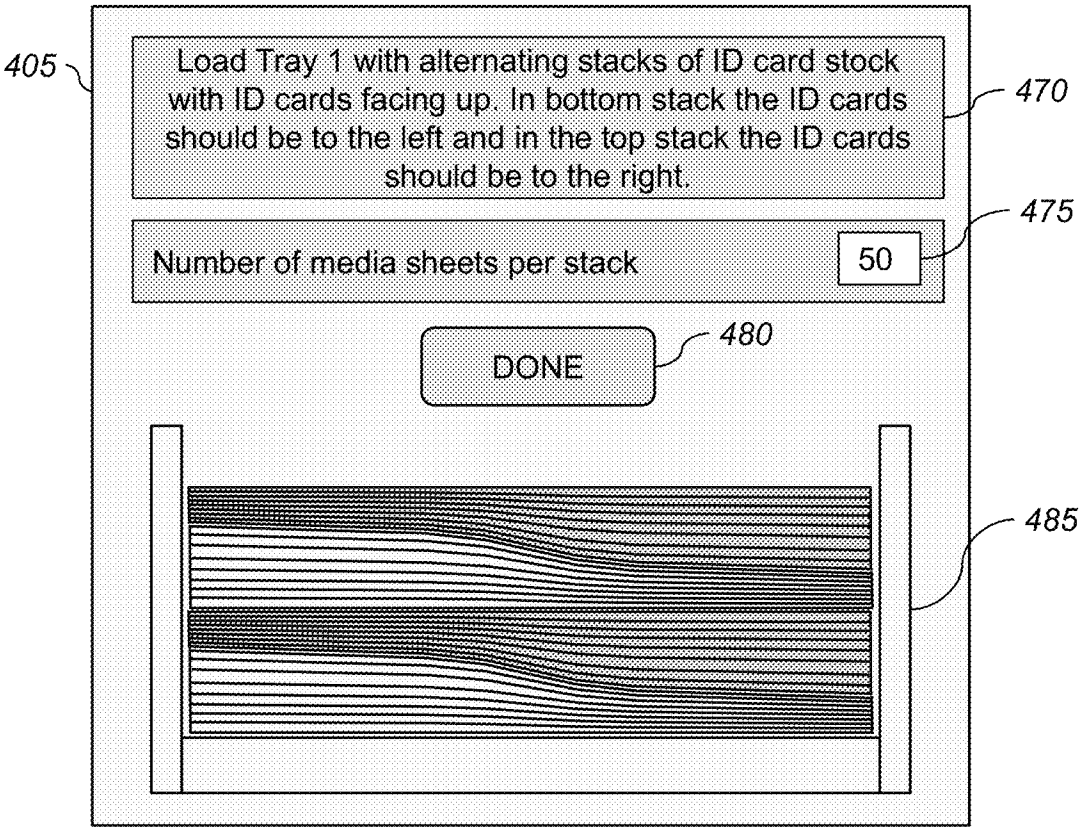
FIG. 7 illustrates an exemplary user interface for use with the method of FIG. 6.

When the printer is to be operated to print on media sheets 300 having a non-uniform thickness profile, the controller 460 performs a display instructions on user interface step 400 to display instructions on a user interface 405 instructing the operator to load the media tray 340 (FIG. 5) with a stack of media sheets 300 having a specified pattern of media orientations. An exemplary user interface 405 is shown in FIG. 7. The user interface 405 includes text providing instructions 470 for the operator. The user interface 405 optionally includes fields enabling the operator to specify parameters defining the pattern of orientations. In the illustrated example, a stack size field 475 is provided that allows the operator to specify the number of media sheets 300 (N) in the individual "stacks" of media sheets that are to be loaded in alternating orientations. The user interface 405 also can optionally include an illustration 485 that can be useful to assist the user in understanding the instructions 470. A done button 480 is provided to enable the operator to confirm that the media loading operation has been completed.

Returning to a discussion of FIG. 6, the controller 460 now performs a control media transport system step 410 to control the media transport system of the printer 100 to pick sequential media sheets 300 from the media tray 340 (FIG. 5). The media transport system can include components such as rollers, belts, media guides and the transport web 81 (FIG. 1) and is configured to pick the next media sheet 300 from the media tray 340 and transport it along a media transport path through the printer 100 where image data can be printed using one or more printer modules 31, 32, 33, 34, 35 (FIG. 1). Given that the controller 460 knows the pattern of media orientations, it will know which media orientation each sequential media sheet 300 will have.

The controller 460 next performs a send instructions to front end step 420 to instruct the front end 425 to sequentially supply image data to be printed on the picked media sheets 300 in accordance with the prescribed pattern of media orientations. This will typically involve rotating the image data by 180° for media sheets 300 in one of the media orientations (e.g., first media orientation 350 in FIG. 5) and leaving the image data unrotated for media sheets 300 in the other media orientation (e.g., second media orientation 355 in FIG. 5).

The controller 460 then performs a control printing module(s) step 430 to control one or more printing module(s) 435 (e.g., printer modules 31, 32, 33, 34, 35 of FIG. 1) to sequentially print the supplied image data 445 on the media sheets 300 in accordance with the prescribed pattern of media orientations to produce a sequence of printed images 450. The controller repeats steps 410, 420 and 430 until all of the pages in the print job have been printed.

If additional print jobs are to be printed on the same type of media, the display instructions on user interface step 400 can be skipped provided that sufficient media sheets 300 remain in the media tray 340. In this case, the controller 460 will be aware of where the next media sheet 300 is in the sequence of prescribed pattern of media orientations and can control the orientation of the image data 445 accordingly.

If all of the media sheets 300 in the media tray 340 are used up in the middle of a print job, the controller can then perform the display instructions on user interface step 400 again to instruct the operator to reload the media tray 340 with a new media stack 325 having the prescribed pattern of media orientations.

The embodiment of FIG. 6 is susceptible to operator error since it relies on the operator to correctly follow the instructions 470 (FIG. 7) presented on the user interface 405 to load the media sheets 300. It can also be complicated to recover from errors (e.g., printer jams or media pick errors) since it requires accurate knowledge of the pattern of media orientations for the remaining media sheets 300 in the media tray 340, and requires synchronizing this pattern with the image data 445 being printed, including any pages which may need to be reprinted. This can be mitigated by including a means to detect the media orientation of each media sheet 300 during the printing process rather than relying on a priori knowledge of the pattern of media orientations.

Figure 8:
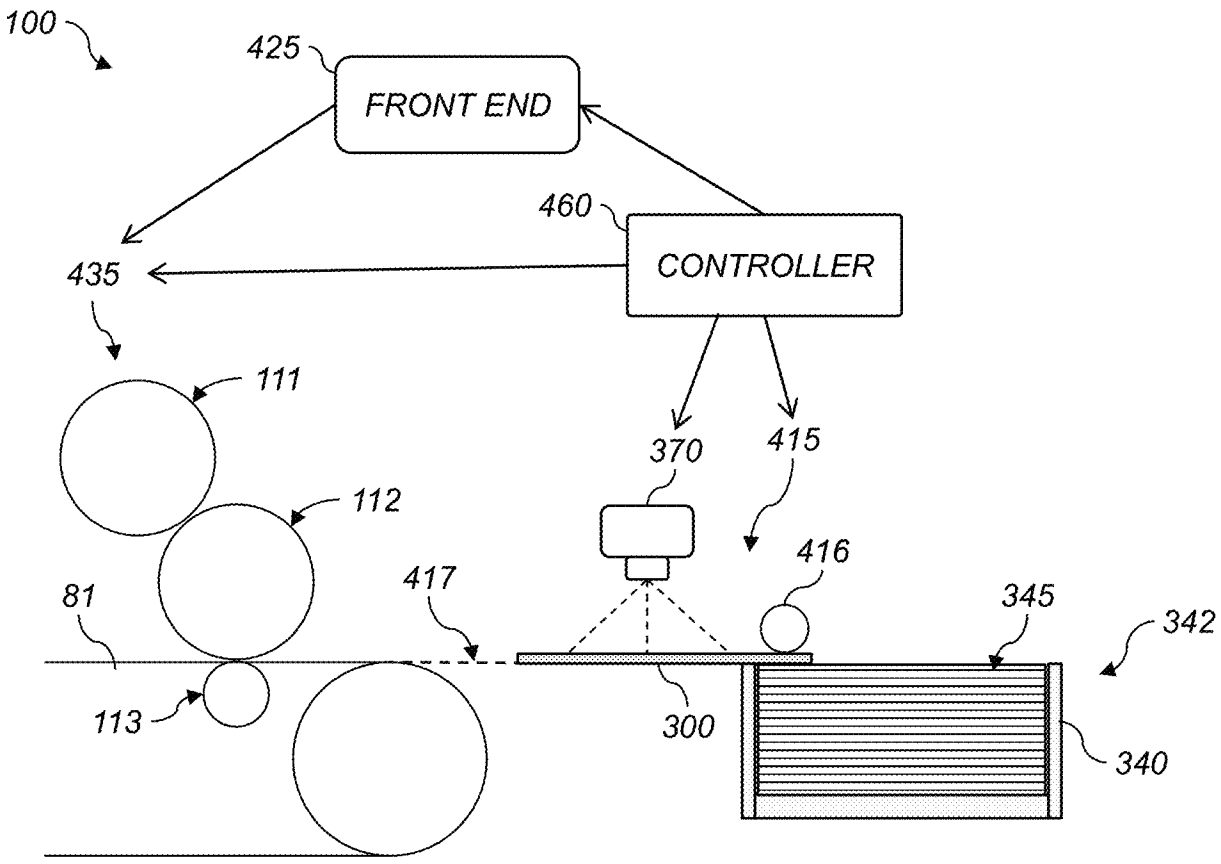
FIG. 8 shows a printer including a detection system for detecting the media orientation of media sheets having asymmetric media characteristics.

FIG. 8 shows a portion of a printer 100 that includes a detection system 370 that can be used to detect the media orientation of each media sheet 300. A media transport system 415 is used to transport media sheets 300 from a media stack 345 loaded into a media supply 342 which includes a media tray 340. In various embodiments, the media sheets 300 have asymmetric media characteristics (e.g., non-uniform thickness profiles such as those of the ID card media of FIGS. 3A-3C). The media sheets 300 are generally loaded in a pattern of media orientations which includes two or more different media orientations. The media transport system 415 can include various components such as rollers 416 and a transport web 81, as well as other components such as belts and media guides (not shown). The printer 100 includes at least one printing module 435 for printing on the media sheets 300. In an exemplary embodiment, the printing module 435 is similar to the printing module 31 of FIG. 2 and includes an imaging member 111, an intermediate transfer member 112 and a transfer backup member 113. The media sheet 300 is transported past the printing module 435 using a transport web 81. It will be obvious to one skilled in the art that the method of the present invention can alternatively be applied to printing systems including other types of printing modules 435, including other types of electrophotographic printing modules or other types of printing technology which are capable of variable data printing such as inkjet printers. A controller 460 is used to control various printer components including the media transport system 415, the detection system, a front end 425 that supplies image data, and the printing module(s) 435.

Figure 9:
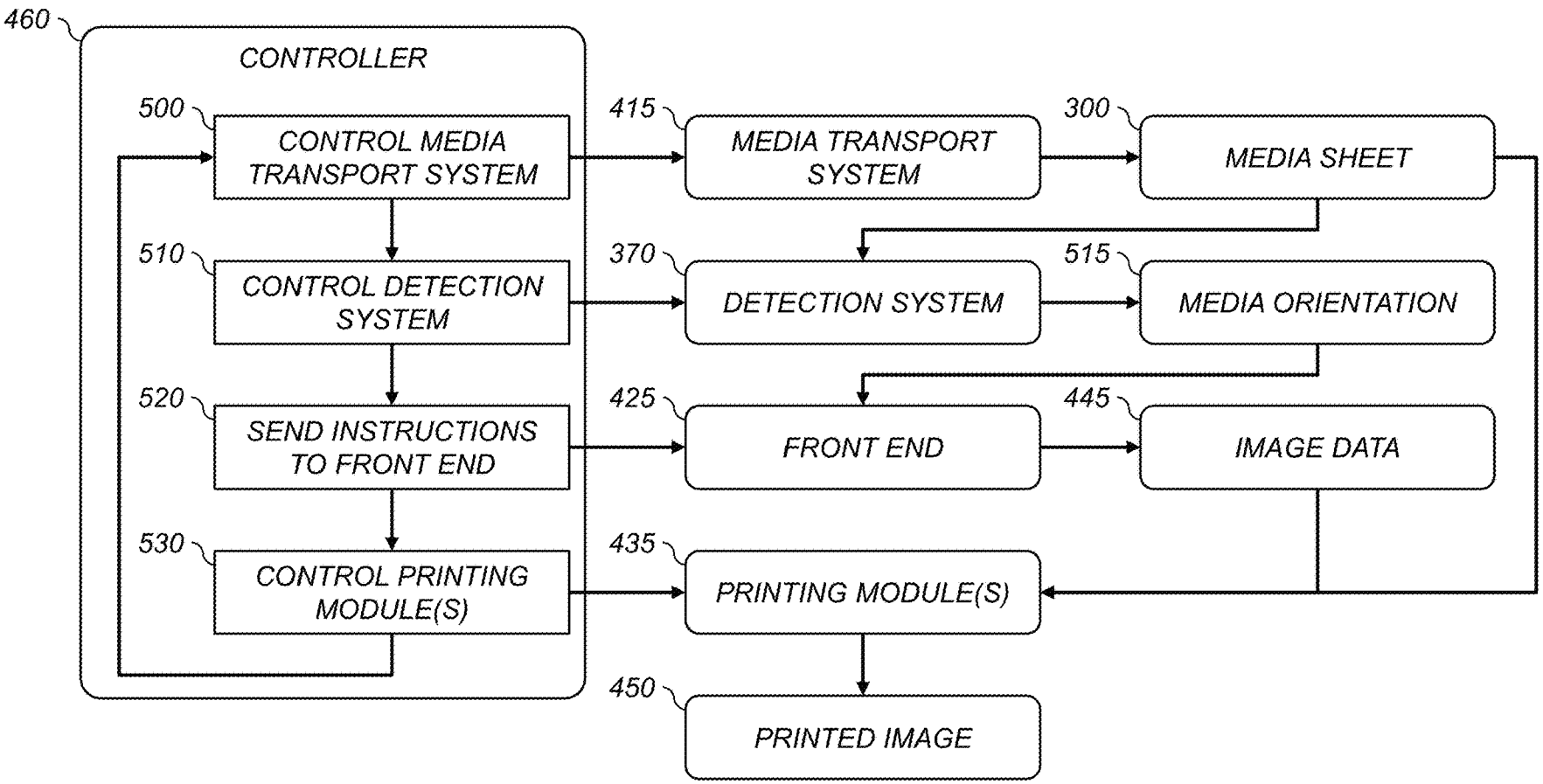
FIG. 9 shows a flowchart of a method for printing on media with asymmetric characteristics in accordance with an exemplary embodiment.

FIG. 9 is a flowchart showing how the printer 100 of FIG. 8 can be controlled in accordance with an exemplary embodiment. Similar to the method of FIG. 6, a controller 460 controls the operation of the printing system 100 (FIG. 1) to perform the method of the invention, in this case a method for printing on media having asymmetric media characteristics. a control media transport system step 500 controls the media transport system 415 to pick the next media sheet 300 from the media tray 340 (FIG. 8). In an exemplary embodiment, the media tray 340 is loaded with media sheets 300 having non-uniform thickness profiles loaded in a pattern of alternating media orientations as was discussed relative to FIG. 5. However, in this case it is not crucial to know exactly what the pattern of media orientations is. As will discussed later, in other embodiments other types of media with asymmetric media characteristics can also be used in accordance with the present invention.

The media transport system 415 transports the picked media sheet 300 past detection system 370, at which time the controller 460 controls the detection system 370 to detect the media orientation 515 of the media sheet 300. The detection system 370 can take any appropriate form known in the art that is capable of automatically detecting the media orientation 515. In an exemplary embodiment, the detection system 370 is an image capture system such as a digital camera or a digital scanning system which captures a digital image of the media sheet (either by reflection or transmission) as it passes along the media transport path 417 (FIG. 8) past the detection system 370. The captured digital image is then automatically analyzed to detect the media orientation 515. While FIG. 8 depicts a single detection system 370 associated with a single media supply 342, it will be obvious that for printers 100 having a plurality of media supplies 342, detection systems 370 can be supplied for each of the media supplies 342. Alternatively, the detection system 370 can be positioned along the media transport path 417 at a point where the media transport path 417 for the different media supplies 342 have merged. In some embodiments, detection systems 370 can be provided to detect signals (e.g., digital images) from both sides (i.e., the front and back sides) of the media sheet 300. This enables detection of whether the media sheets 300 were loaded face-up or face-down in the media tray 340, in addition to detecting which end of the media sheets 300 were toward which end of the media tray 340.

Figure 10:
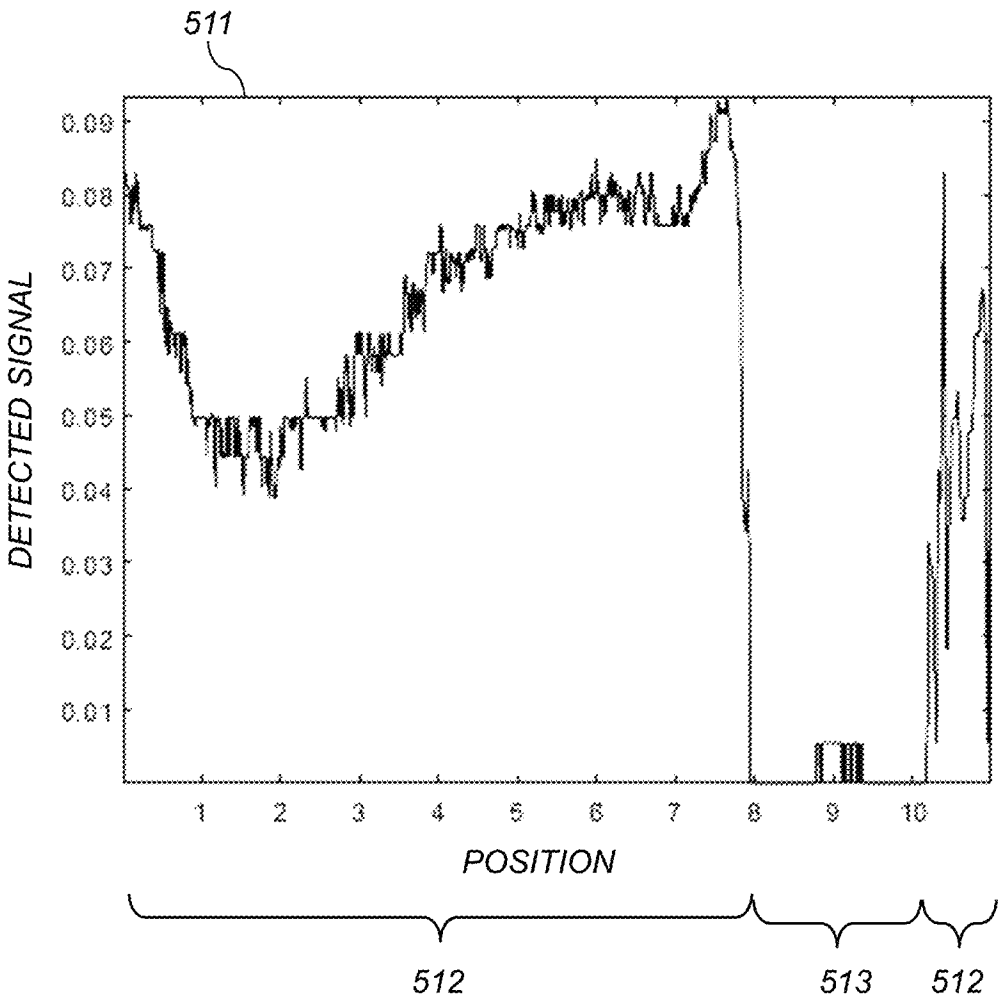
FIG. 10 shows an exemplary detection signal determined for a piece of ID card media.

In an exemplary configuration, the digital image is analyzed by detecting patterns of image signals (e.g., corresponding to non-uniform reflectance or transmittance characteristics) that are characteristic of the asymmetric media characteristics. For example, FIG. 10 shows a detection signal 511 determined by computing the average detected pixel values across each line of the digital image data. In this case, the media sheet 300 is a piece of ID card media such as that illustrated in FIG. 3A which includes an ID card 310 at one end of the media sheet 300. It can be seen that the detected signal has different characteristics at different positions from the top to the bottom of the media sheet. In particular the detected signal is higher in the regions corresponding to the substrate 305 (corresponding to substrate signal 512) than it is in the region that contains the ID card 310 (corresponding to ID card signal 513). The orientation of the media sheet 330 can be inferred by determining which end of the detection signal 511 includes the ID card signal 513). It should be noted that if the improper media is loaded in the media tray 340 (FIG. 8), the detection signal 511 would not have the expected characteristics. If analysis of the detection signal 511 determines that it doesn't have the expected characteristics associated with the intended media type, an error message can be presented to the user and the print job can be stopped.

It will be obvious to one skilled in the art that other types of image analysis can alternatively be used to detect the media orientation. For example, the boundary of the ID card 310 can be detected in the captured digital image using conventional image analysis techniques such as matched filter analysis to compare the captured digital image to feature vectors associated with features of the intended media type.

Other types of detection systems 370 that can be used to detect the media orientation 515 of the media sheet 300 in accordance with the present invention would include mechanical or optical thickness sensors that detect the thickness of the media sheet 300 as it moves along the media transport path 417. The media orientation 515 of media sheets 300 having non-uniform thickness profiles can then be detected by analyzing the thickness profile along the length of the media. Other media characteristics that vary across the media sheet 300 can also be used with appropriate sensing means. For example, if the gloss of the ID card 310 is different than the gloss of the substrate 305 a gloss meter can be used to detect the location of the ID card 310, thereby providing an indication of the media orientation 515. In some embodiments, detection systems 370 that use Near InfraRed (NIR) spectroscopy can be used to classify the material for the media sheet 300 (e.g., plastic vs paper substrate).

Returning to a discussion of FIG. 9, the controller 460 next performs a send instructions to front end step 520 to instruct the front end 425 to supply image data 445 having an orientation matching the detected media orientation 515. This would typically involve the front end 425 rotating the image data 445 by 180° for one of the media orientations 515. This can be performed on a page by page basis based on the detected media orientation 515 so that it is not necessary to have any a priori knowledge of the pattern of media orientations 515 in the media stack 345.

Finally, the controller 460 performs a control printing module(s) step 530 which controls the one or more printing module(s) 435 of the printer 100 to print the supplied image data 445 onto the media sheet 300 in accordance with the detected media orientation 515 to form a printed image 450. The steps of FIG. 9 are then repeated for all of the pages of the print job, sequentially printing the image data on each sequential media sheet 300 in accordance with the corresponding detected media orientation 515.

While the exemplary embodiment discussed with respect to the above discussion of FIG. 9 has focused on ID card media as an example of media sheets 300 with asymmetric media characteristics, it will be obvious to one skilled in the art that the same method can be applied to a wide variety of different asymmetric media types. Within the context of the present invention asymmetric media characteristics include any physical characteristic that varies across the area of the media sheet. The physical characteristics can vary in any pattern including being different from top-to-bottom, side-to-side or front-to-back. Examples of the characteristics that can be asymmetric include thickness, materials affixed to the surface (e.g., ID cards, stickers, seals), surface texture (e.g., embossing), surface characteristics (e.g., gloss, coatings), media composition (paper type), pre-printed content (e.g., letterhead) and physical shape (e.g., punched holes, chamfered corners, tabs). Media sheets 300 for a number of such media types with asymmetric characteristics are illustrated in FIGS. 11A-11D.

Figure 11A:
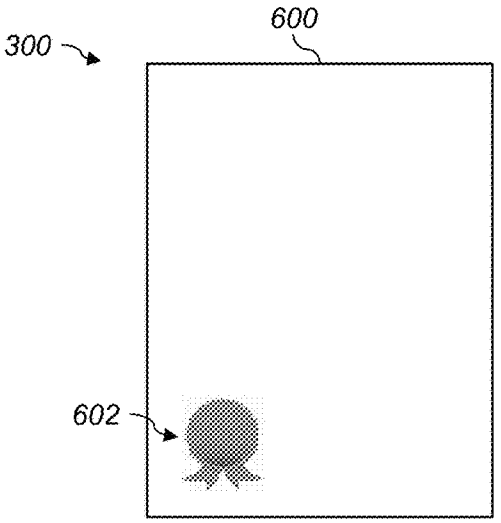
FIG. 11A-11D illustrate exemplary types of media having asymmetric media characteristics.

FIG. 11A depicts an embossed seal media 600 which includes an embossed seal 602 which is pre-affixed to the substrate and embossed prior to loading the media sheets 300 into the media tray 340. For example, the embossed seal media 600 can be used for documents such as diplomas or award certificates. This type of media is another example of a media having non-uniform thickness characteristics since the seal will add thickness and the embossing pattern will further modulate the height/texture of the media surface. Alternatively, some types of media sheets 300 can include a sticker or a label affixed to its surface which will behave similarly to a seal.

Figure 11B:
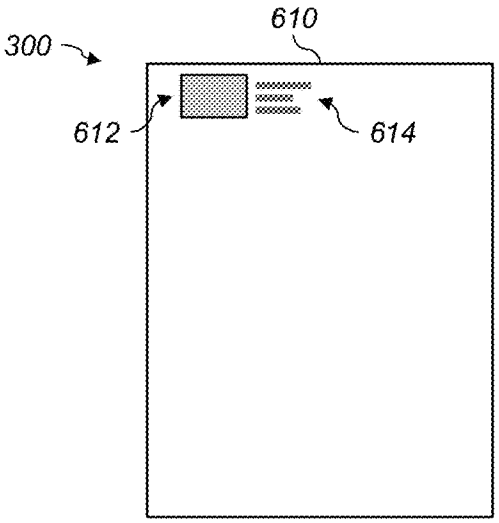

FIG. 11B depicts a letterhead media 610 which includes preprinted content such as a logo 612 and text 614 such as a company name and address. While this type of media does not typically have non-uniform thickness characteristics, it does have asymmetric characteristics such that it is important to make sure that the image is printed on the letterhead media 610 in the correct orientation. By detecting the media orientation 515 it makes it possible to correctly print on the letterhead media 610 independent of which way it was loaded into the media tray 640.

Figure 11C:
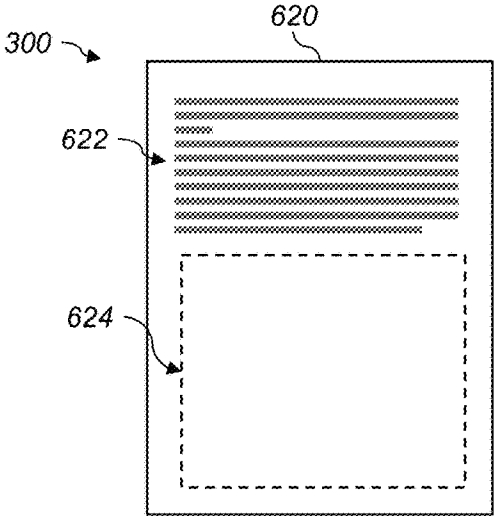

FIG. 11C depicts a preprinted content media 620 which includes preprinted content 622 as well as a variable content region 624 where image data 445 (FIG. 9) can be printed by the printer 100 (FIG. 1). For example, the preprinted content media 620 can be a form letter or advertisement which is to be customized with the name of a recipient and other information that may be pertinent to the recipient. As with the letterhead media 610 of FIG. 11B, the preprinted content media 620 will typically not have a non-uniform thickness profile but it is asymmetric such that it is important that the image content be printed in the proper orientation.

Figure 11D:
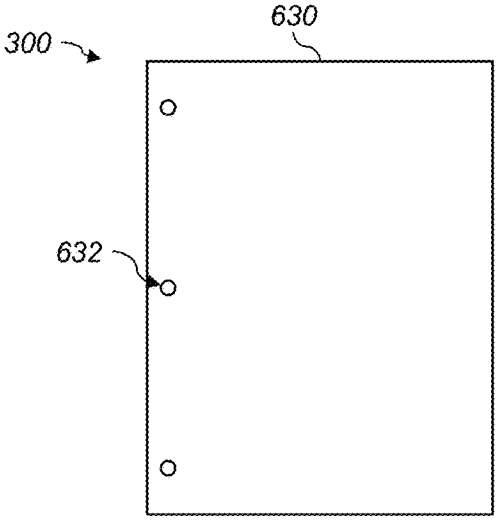

FIG. 11D depicts a pre-punched hold media 630 including a series of pre-punched holes 632 along one edge of the media for use with a loose-leaf binder. It is important to be able to print the image data 445 onto the pre-punched hold media 630 in the proper orientation so that it can be properly inserted into the loose-leaf binder.

Figure 12:
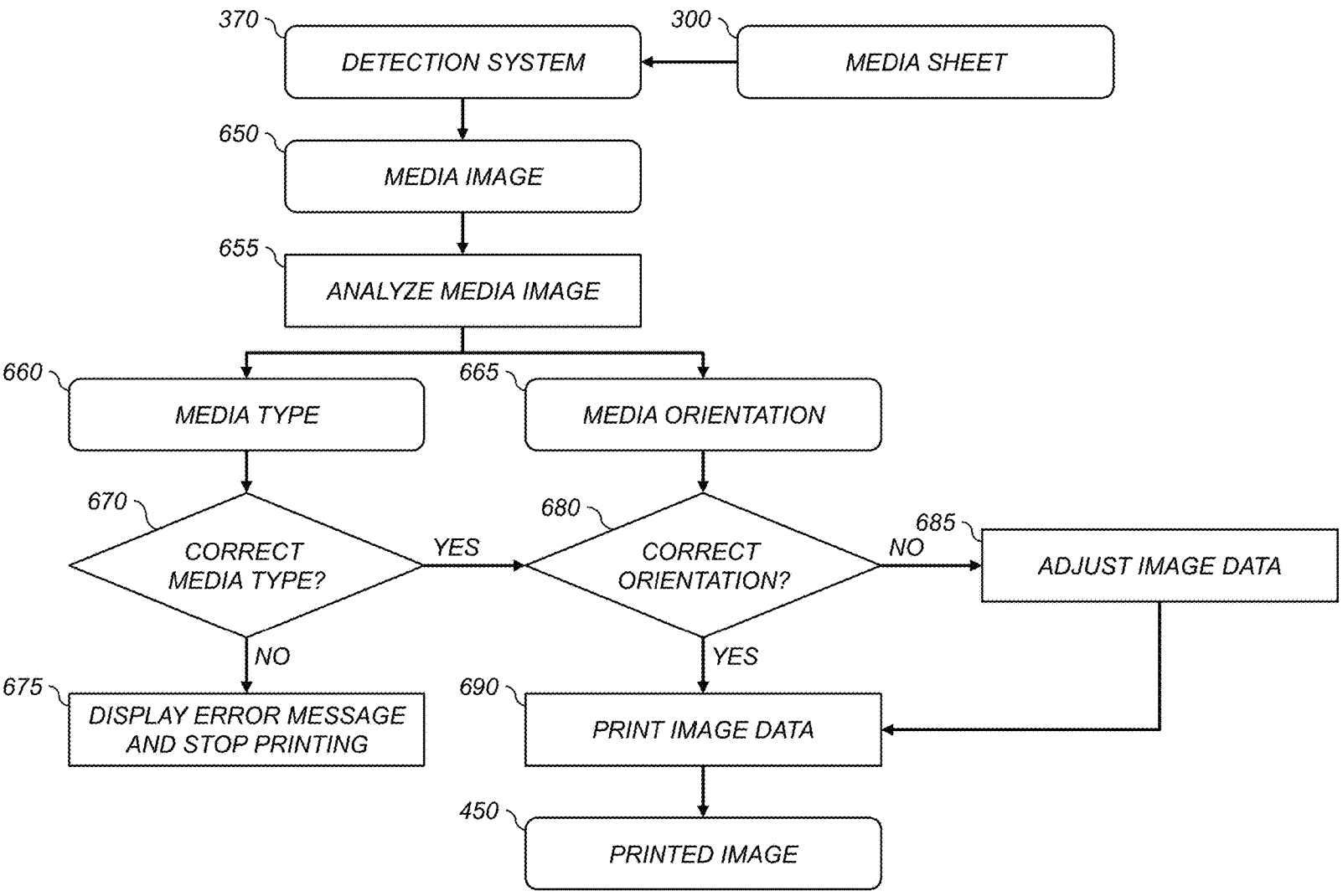
FIG. 12 illustrates a flow chart of a process for printing on media sheets with asymmetric media characteristics in accordance with an exemplary embodiment.

FIG. 12 illustrates a flow chart of a process for printing on media sheets 300 with asymmetric media characteristics in accordance with an exemplary embodiment. The detection system 370 is used to capture a media image 650 of the media sheet 300, typically as it is being transported along the media transport path 417 from the media tray 340 to the printing module 435 (FIG. 8).

An analyze media image step 655 is then used to analyze the media image 650 to determine both a media type 660 and a media orientation 665. The media type 660 can be determined by comparing characteristics of the captured media image 650 with characteristics of known media types. For examples, matched filter analysis can be used to compare the media image 650 to the image content of media types such as those depicted in FIGS. 3A and 11A-11D. The media orientation 665 can likewise be determined as discussed earlier by determining the position of detected media features relative to the ends of the media sheet 300 (and optionally to the front/back of the media sheet 300). In some embodiments, samples of media sheets 300 for each of the different media types that will be used in a particular printing system can be positioned in a reference orientation and imaged ahead of time using the detection system 370 to provide reference media images. The captured media image 650 can then be digitally rotated to different orientations and compared to the reference media images to determine a matching media type 660 and media orientation 665. Methods for comparing two digital images to determine whether they match are well-known in the art, and any such method can be used in accordance with the present invention. A process can be defined that enables an operator to add a new media type to the library of reference media types.

A correct media type test 670 is used to compare the detected media type 660 to an expected media type required for the print job. For example, if a print job is to be printed on ID card media, the correct media type test 670 would confirm that the media sheet 300 has the correct media type 660. If the media type 660 is incorrect, a display error message and stop printing step 675 is used to inform the user that the incorrect media type is loaded in the media tray 340.

If the media type 660 is correct, then a correct orientation test 680 is used to compare the media orientation 665 to an expected media orientation. If the media orientation 665 is incorrect (e.g., if the media sheets 300 are loaded into the media tray 340 in an orientation different than that associated with the image data to be printed), then an adjust image data step 685 is used to rotate the image data so that it is properly aligned with the detected media orientation 665. Typically this would involve rotating the image data by 180°, or possibly adjusting which side of the media sheet 300 the image data is printed on.

A print image data step 690 is then used to print the image data onto the media sheet 300 in the proper orientation to form printed image 450. The process of FIG. 12 can then be repeated for each page of the print job.

A special case of media having asymmetric media characteristics is tabbed media which is used for tabbed dividers in a loose-leaf notebook. This type of media is available in a variety of different configurations (e.g., different numbers of tab positions and different tab styles), and can be loaded into a particular media tray such that the printer 100 can insert it into appropriate locations in the print job. The printer 100 can print labels onto the tabs of the tabbed media to label different sections of a document.

Figure 13A:
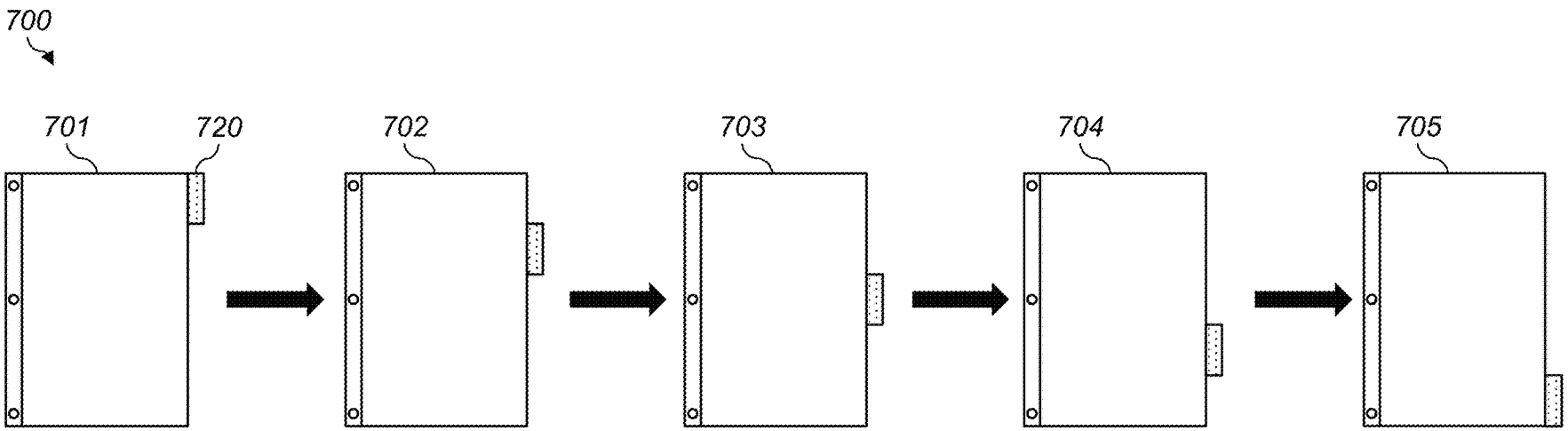
FIG. 13A-13B show examples of tabbed media sheets.
Figure 13B:
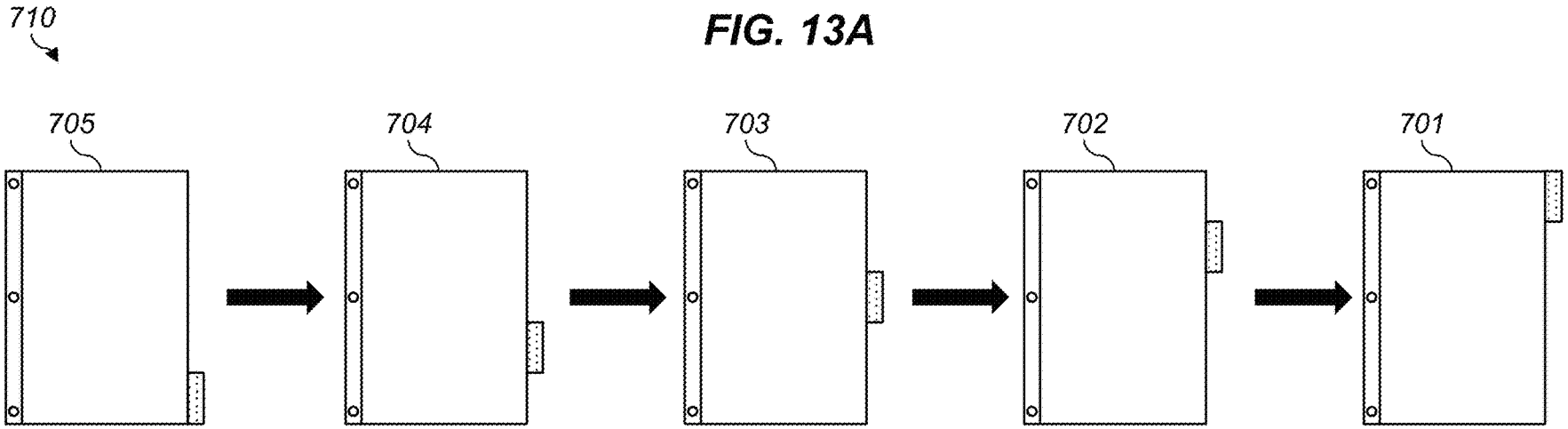

Tabbed media is available in two different tab orders, in the top-to-bottom tabbed media 700 illustrated in FIG. 13A the first media sheet has its tab 720 in a first tab position 701 at the top of the media sheet. Subsequent media sheets have tabs 720 in a sequence of tab positions that move down the page. In the illustrated example there are a total of 5 different tab positions (first tab position 701, second tab position 702, third tab position 703, fourth tab position 704 and fifth tab position 705), although tabbed media is available with different numbers of tab positions. Tabbed media is also available in a bottom-to-top tab order as illustrated by the bottom-to-top tabbed media 710 shown in FIG. 13B in which the tab positions are reversed in the sequence relative to the top-to-bottom tabbed media 700 of FIG. 13A.

Figure 14:
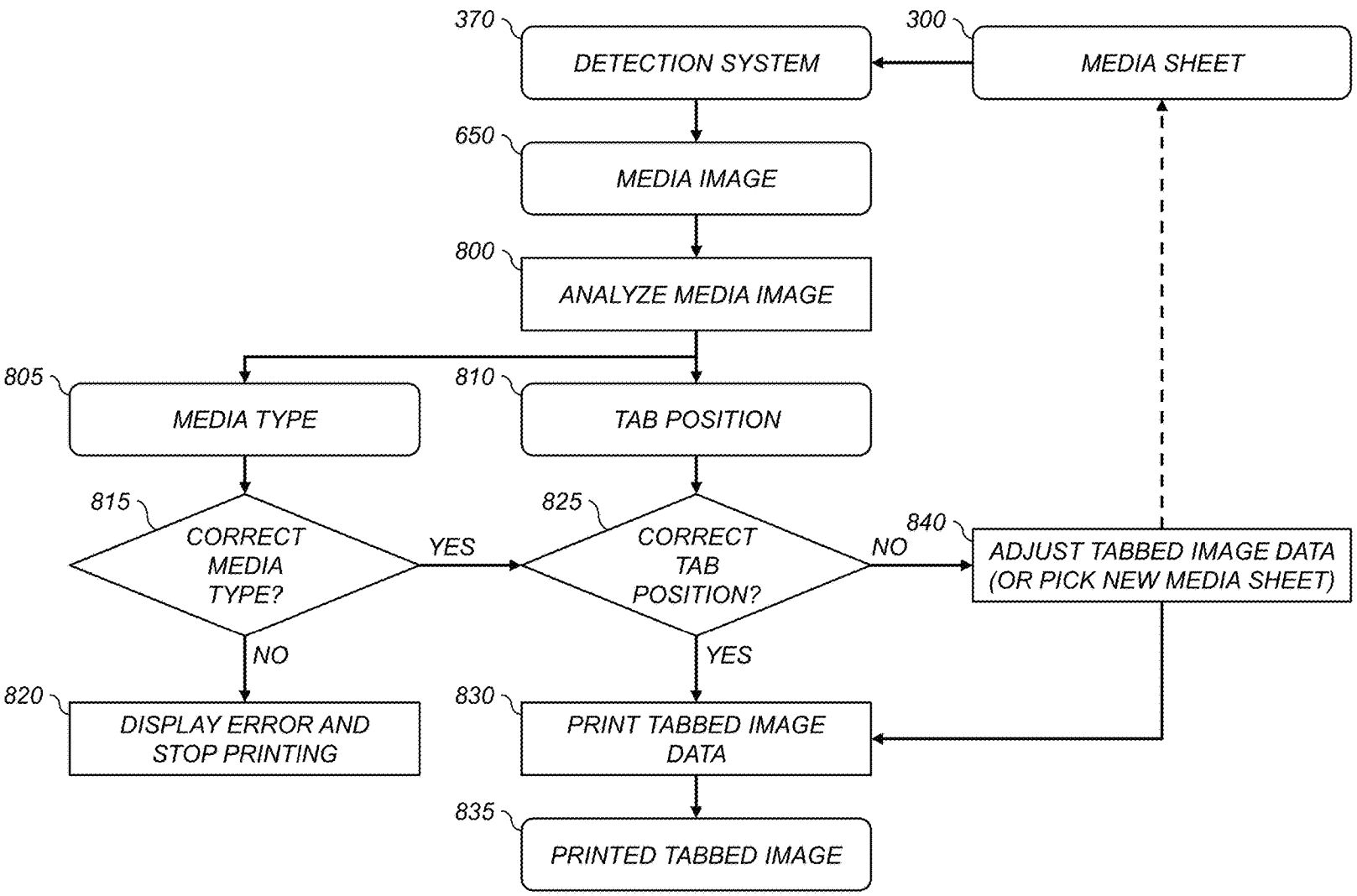
FIG. 14 illustrates a flow chart of a process for printing on tabbed media in accordance with an exemplary embodiment.

When printing on tabbed media, it is important to properly align the image data to be printed with the appropriate tab position. FIG. 14 shows a flowchart of a method for printing on tabbed media sheets 300 in accordance to an exemplary embodiment. The detection system 370 is used to capture a media image 650 of the tabbed media sheet 300, typically as it is being transported along the media transport path 417 from the media tray 340 to the printing module 435 (FIG. 8).

An analyze media image step 800 is then used to analyze the media image 650 to determine both a media type 805 and a tab position 810. The media type 660 can be determined by comparing characteristics of the captured media image 650 with characteristics of known media types. In this case, the media image 650 is analyzed to detect the presence of a tab along the edge of the media sheet 300 to determine if it is a tabbed media. If so, an associated tab position 810 is also determined.

A correct media type test 815 is used to compare the detected media type 805 to the expected tabbed media type. In addition to determining whether the media sheet 300 is a tabbed media, the size and characteristics of the tab can also be used to determine the type of tabbed media (i.e., the number of tab positions, etc.) If the media type 805 is incorrect, a display error message and stop printing step 820 is used to inform the user that the incorrect media type is loaded in the media tray 340.

If the media type 805 is correct, then a correct tab position test 825 is used to compare the tab position 810 to an expected tab position. If the tab position 810 is incorrect (e.g., if the media sheets 300 are loaded into the media tray 340 in a different order or orientation than expected), then an adjust tabbed image data or pick new media sheet step 840 is used to correct the problem.

In some cases, the image data can be adjusted to print the tab data in the detected tab position 810 rather than the originally expected tab position. For example, if the detection system 370 determines the sequence of tab positions 810 for sequential media sheets 300 of tabbed media is different from an expected sequence of tab positions (e.g., if top-to-bottom tabbed media 700 is loaded rather than the expected bottom-to-top tabbed media 710 or if 7-tab tabbed media is loaded rather than the expected 5-tab tabbed media), then the front end can be instructed to adjust the image data accordingly in order to supply image data to be printed on the correct tab positions.

In other cases, the media sheet with the incorrect tab position can be directed into a waste receptacle (sometimes referred to as a waste bin), or alternatively to an exit tray), and the next media sheet 300 is picked and analyzed until a tabbed media sheet having the expected tab position is detected. For example, this might be appropriate if it is determined that the media sheets 300 in the media tray 340 start in the middle of the sequence of tab positions rather than with the expected first tab position (e.g., if the previous print job ended in the middle of the tab sequence). It could also be appropriate if the media sheet 300 with a particular tab position is missing from the media tray for some reason (e.g., if it has been accidentally discarded during the loading process).

A print tabbed image data step 830 is then used to print the tabbed image data onto the media sheet 300 in the proper tab position to form printed tabbed image 838. The process of FIG. 14 can then be repeated for each tabbed page of the print job.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image
39 fused image
40 supply unit
42 receiver
42*a* receiver
42*b* receiver
50 transfer subsystem
60 fuser module
62 fusing roller
64 pressure roller
66 fusing nip
68 release fluid application substation
69 output tray
70 finisher
81 transport web
86 cleaning station
99 logic and control unit
100 printer
111 imaging member
112 intermediate transfer member
113 transfer backup member
201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 media sheet
305 substrate
310 ID card
315 first end
320 second end
325 media stack
330 top surface
335 leveler
337 adjustable platform
340 media tray
342 media supply
345 media stack
350 first media orientation
355 second media orientation
360 first side
365 second side
370 detection system
400 display instructions on user interface step
405 user interface
410 control media transport system step
415 media transport system
416 roller
417 media transport path
420 send instructions to front end step
425 front end
430 control printing module step
435 printing module
445 image data
450 printed image
460 controller
470 instructions
475 stack size field
480 done button
485 illustration
500 control media transport system step
510 control detection system step
511 detection signal
512 substrate signal
513 ID card signal
515 media orientation
520 send instructions to front end step
530 control printing module(s) step
600 embossed seal media
602 embossed seal
610 letterhead media
612 logo
614 text
620 preprinted content media
622 preprinted content
624 variable content region
630 pre-punched hole media
632 pre-punched hole
650 media image
655 analyze media image step
660 media type
665 media orientation
670 correct media type test
675 display error message and stop printing step
680 correct orientation test
685 adjust image data step
690 print image data step
700 top-to-bottom tabbed media
701 first tab position
702 second tab position
703 third tab position
704 fourth tab position
705 fifth tab position
710 bottom-to-top tabbed media
720 tab
800 analyze media image step
805 media type
810 tab position
815 correct media type test

820 display error and stop printing step
825 correct tab position test
830 print tabbed image data step
835 printed tabbed image
840 adjust tabbed image data or pick new media sheet step

The invention claimed is:

1. A printing system for printing on tabbed media having a plurality of tab positions, comprising:

a printing module for printing on sheets of tabbed media;

a front end for supplying image data to the printing module;

a media supply including a media tray adapted to be loaded with a plurality of sheets of tabbed media;

a media transport system configured to pick a next sheet of tabbed media from the media tray and direct it to the printing module;

a detection system configured to automatically detect the tab position of the picked sheet of tabbed media; and a control system programmed to:

control the media transport system to pick the next sheet of tabbed media from the media tray;

control the detection system to detect the tab position for the sheet of tabbed media;

compare the detected tab position to an expected tab position and if the detected tab position is the same as the expected tab position instruct the front end to supply image data to be printed on the sheet of tabbed media having the expected tab position, and if the detected tab position is different from the expected tab position either:

instruct the front end to supply image data to be printed on the sheet of tabbed media having the detected tab position; or control the media transport system to direct the sheet of tabbed media into a waste receptacle and pick one or more additional sheets of tabbed media until the detected tab position is the same as the expected tab position, and instruct the front end to supply image data to be printed on the sheet of tabbed media having the expected tab position; and control the printing module to print the supplied image data on the sheet of tabbed media.

2. The printing system of claim 1, wherein the detection system includes:

an imaging system configured to capture an image of the sheet of tabbed media; and an analysis system configured to analyze the captured image to detect the tab position.

3. The printing system of claim 2, wherein the analysis system determines the detected tab position by detecting the tab in the captured image.

4. The printing system of claim 1, wherein the detection system determines a sequence of tab positions for sequential sheets of tabbed media, and wherein if the determined sequence of tab position is reversed relative to an expected sequence of tab positions the front end is instructed to supply image data to be printed on the sheets of tabbed media having the reversed sequence of tab positions.

5. The printing system of claim 1, wherein the detection system determines a sequence of tab positions for sequential sheets of tabbed media, and wherein if the determined sequence of tab position has a different number of tab positions relative to an expected sequence of tab positions the front end is instructed to supply image data to be printed on the sheets of tabbed media having the determined number of tab positions.

6. The printing system of claim 1, wherein the detection system determines a sequence of tab positions for sequential sheets of tabbed media, and wherein if the determined sequence of tab position starts at a different first tab position relative to an expected first tab position the media transport system is controlled to direct the sheet of tabbed media into a waste receptacle and pick one or more additional sheets of tabbed media until the detected tab position is the same as the expected first tab position.

7. The printing system of claim 1, wherein the control module is programmed to control the printing module to print labels onto tabs of the tabbed media.

* * * * *